US006260485B1

(12) United States Patent
Theurer et al.

(10) Patent No.: US 6,260,485 B1
(45) Date of Patent: Jul. 17, 2001

(54) METHOD FOR CORRECTING THE POSITION OF A TRACK

(75) Inventors: Josef Theurer, Vienna; Bernhard Lichtberger, Leonding, both of (AT)

(73) Assignees: Franz Plasser Bahnbaumaschinen; Industriegesellschaft m.b. H., both of Vienna (AT)

( * ) Notice: Subject to any disclaimer, the term of this patent is extended or adjusted under 35 U.S.C. 154(b) by 0 days.

(21) Appl. No.: 09/491,647

(22) Filed: Jan. 27, 2000

(30) Foreign Application Priority Data

Feb. 10, 1999 (AT) ..... 184/99

(51) Int. Cl.[7] ..... E01B 27/00
(52) U.S. Cl. ..... 104/7.2; 33/287
(58) Field of Search ..... 33/1 Q, 286, 287; 104/2, 7.1, 7.2, 10, 12; 701/19

(56) References Cited

U.S. PATENT DOCUMENTS 3,875,865 * 4/1975 Plasser et al. ..... 33/287
4,497,255 * 2/1985 Theurer ..... 104/7.2
5,012,413 * 4/1991 Stroka et al. ..... 104/7.2

OTHER PUBLICATIONS

"Leitcomputer fuer Stopfmaschinen" 44 in the periodical "Der Eisenbahningenieur" (1993) 9, pp. 570–574.

* cited by examiner

*Primary Examiner*—Mark T. Le
(74) *Attorney, Agent, or Firm*—Collard & Roe, P.C.

(57) ABSTRACT

The position of a track is corrected on the basis of the independent and separate measurement of the level errors of each track rail, and by concentrating the correction work on the most egregious position errors. For this purpose, a sub-section of the track is delimited by a starting point and an end point, and each rail in this sub-section is lifted to a desired level which has been electronically determined and is matched to a contiguous track section which has not been corrected.

4 Claims, 2 Drawing Sheets

METHOD FOR CORRECTING THE POSITION OF A TRACK

BACKGROUND OF THE INVENTION

1. Field of the Invention

The present invention relates to a method for correcting the position of a track comprised of two rails fastened to ties.

2. Description of the Prior Art

An article entitled "Leitcomputer fuer Stopfmaschinen" in the periodical "Der Eisenbahningenieur" 44 (1993) 9, pp. 570–574, describes a computer designated "ALC" for optimizing a method for correcting the position of a track. In this method, the operation of a track tamping machine may be controlled not only in response to a known desired geometry of the track but also in response to an unknown desired track geometry. For this purpose, the track tamping machine is advanced along the track to measure its position before the position is corrected, and a desired track position with corresponding correction values is derived from the measured existing track position by means of electronically smoothing existing position errors by versine compensation.

SUMMARY OF THE INVENTION

It is a primary object of this invention to provide a track position correcting method which is particularly useful for optimally eliminating extreme track position errors in short track sections.

The above and other objects are accomplished according to the invention with a method for correcting the position of a track comprised of two rails fastened to ties, which comprises the steps of measuring independently of each other the position of each rail of a track section to obtain and record an existing level by means of a computer and control unit, electronically smoothing existing level errors exceeding a selected tolerance limit to form a desired level, delimiting within the measured track section a sub-section to be brought to the desired level by fixing a starting point and an end point of the sub-section, positioning a tamping unit on a track tamping machine exactly at the starting point, limiting any rail lifting at the starting point to the level of an uncorrected track section adjacent the starting point, and bringing the sub-section to the desired level by lifting and tamping each rail independently of each other until the track sub-section is positioned at the desired level.

Combining these steps enables the position of relatively short sub-sections, which have extreme position errors beyond a selected tolerance limit, to be corrected without incurring the high costs of correcting the position of an entire track section. In this method, the track position errors are durably corrected, on the one hand, while the corrected sub-section is optimally matched to the average existing position of the contiguous track sections which have not been corrected, on the other hand. In this connection, it is essential, particularly in track curves with superelevations, to form a desired position for each rail independently of each other to avoid a warped track after the correction.

BRIEF DESCRIPTION OF THE DRAWING

The above and other objects, advantages and features of the invention will become more apparent from the following detailed description of now preferred embodiments, taken in conjunction with the accompanying drawing wherein.

DETAILED DESCRIPTION OF PREFERRED EMBODIMENTS

Figure 1:
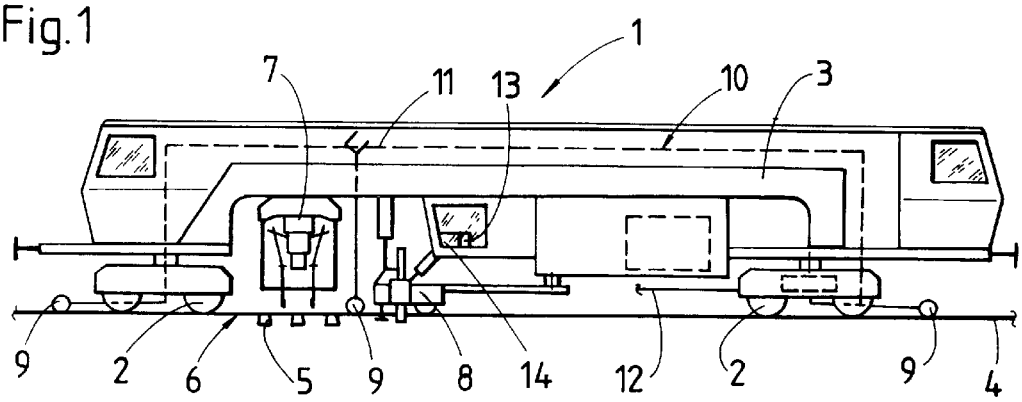
FIG. 1 is a side elevational view of a track tamping machine.

Referring first to FIG. 1, there is shown generally conventional track tamping machine 1 comprising frame 3 supported by undercarriages 2 on track 6 comprised of two rails 4 fastened to ties 5. The track position is corrected by means of tamping units 7 and/or track lifting and lining unit 8 mounted on the machine frame, a respective one of the tamping units being aligned with each rail 4 and the tamping units being vertically adjustable and operable independently of each other.

The track position is measured by reference system 10 rollingly supported on the track rails by sensing rollers 9. The reference system comprises a reference chord 11 aligned with each rail 4 and extending in the direction of the track for sensing the track level, and a further reference chord 12 extending centrally between the rails for sensing the track line. Computer and control unit 13, as well as monitor 14, are arranged in an operator's cab of machine 1 for recording and graphically displaying an existing track position, and for electronically computing a desired track position.

Figure 2:
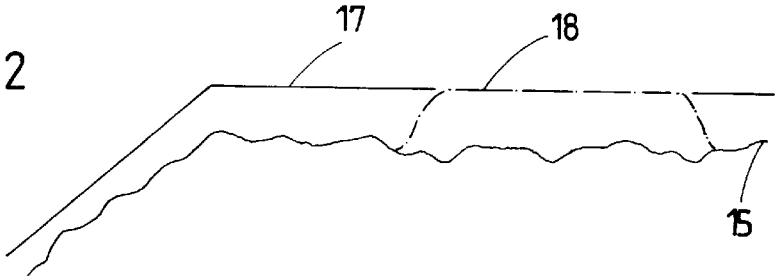
FIGS. 2 to 6 are schematic illustrations showing curves of existing and desired track positions.
Figure 3:
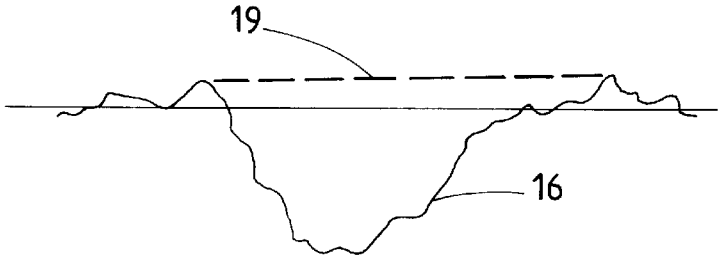

FIGS. 2 and 3 show existing levels 15, 16 of the left and right rails 4. Line 17 in FIG. 2 indicates a theoretical desired level of left rail 4. Line 16 in FIG. 3 indicates an extreme deviation of the existing level from the desired level. If the illustrated position of this track section were to be corrected in the conventional manner, the left rail would be automatically lifted with the aid of a transverse inclination indicator relative to the right rail into the theoretical desired level indicated by dot-dash line 18.

According to the method of the present invention and due to the independent measurement and correction of the position of each rail 4, only the right rail, whose position is indicated in FIG. 3, is lifted to assume the desired level indicated by broken line 19, which desired level is matched to that of the contiguous track sections whose position has not been corrected. Desired level 19 is obtained by electronically smoothing the position of the right rail in a known method of versine compensation after existing level 15 of the left rail has been obtained and recorded by means of computer and control unit 13. The left rail on the other side of this sub-section is at a higher level than the right rail and remains unchanged if its existing level is acceptable. If the existing level 15 of the left rail has errors beyond a selected tolerance, it is also corrected and matched to the contiguous track sections. Transverse track inclination indicators on machine 1 serve only to indicate existing superelevations and have no influence on the track position correction.

Figure 6:
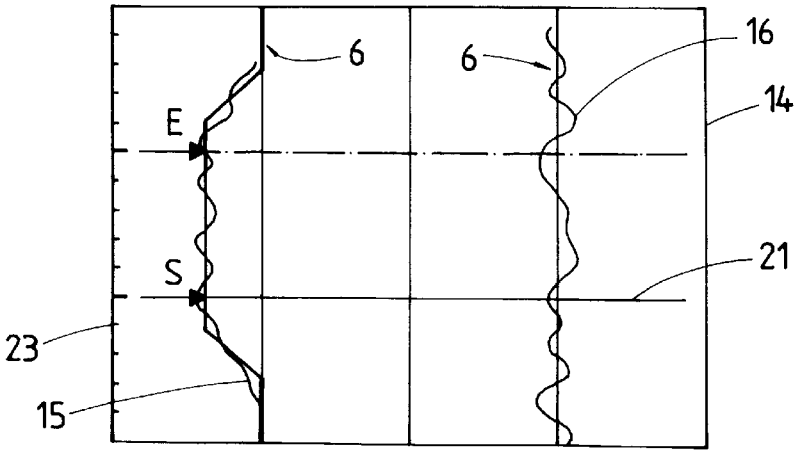
Figure 4:
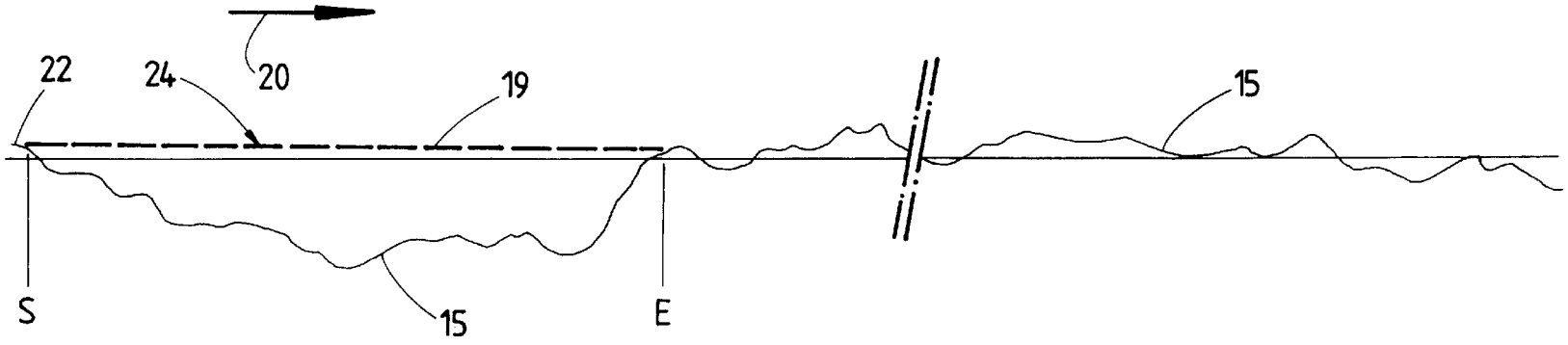
Figure 5:
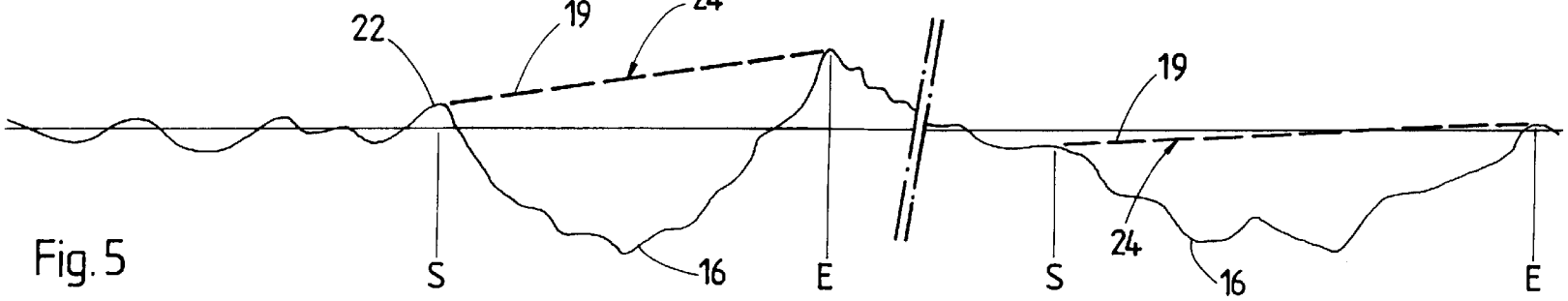

The method of this invention will now be more fully described in connection with FIGS. 4 to 6.

Track tamping machine 1 is advanced along track 6 in an operating direction indicated by arrow 20, and the existing position 15 (left rail in FIG. 4) is measured independently of the existing position 16 (right rail in FIG. 5) to obtain and record an existing level of each rail by means of computer and control unit 13. Subsequently, existing level errors exceeding a selected tolerance limit are electronically smoothed in a known manner to form a desired level indicated by broken line 24, and the track level is graphically displayed on monitor 14.

A sub-section 24 whose position is to be corrected to be brought to the desired level is either manually or automatically delimited within the measured track section by fixing a starting point S and an end point E of the sub-section. Track tamping machine 1 is then moved to position tamping unit 7 exactly at and above starting point S. This exact positioning may be observed by an operator viewing monitor 14 (FIG. 6) where a cursor line 21 moves synchronously to the movement of machine 1 along track 6 and the graphically displayed existing and desired rail levels. The monitor also displays the distance traveled by machine 1 at 23.

After the positioning of the tamping machine at starting point S, tamping unit 7 aligned with the left rail is lowered to be immersed in the ballast to tamp the ballast under tie 5, only this left rail being lifted by track lifting and lining unit 8 to desired level 19 obtained by the electronic smoothing of the track.

Since the position of the right rail is independently measured as soon as the track position correction begins, the tamping unit aligned with the right rail will be automatically lowered when it has reached starting point S. As soon as end point E for each rail 4 has been reached, the track position correction is terminated.

This method has the advantage that track position correction work may be concentrated on extreme position errors and may, therefore, be done relatively quickly while track sections which have only tolerably acceptable position errors remain advantageously uncorrected in their highly tamped, stabilized condition.

In this connection, it is essential that any rail lifting at starting point S of the track position correction be limited to the level of uncorrected track section 22 adjacent the starting point S and contiguous with sub-section 24 being corrected. The sub-section is brought to desired level 19 by lifting and tamping each rail 4 independently of each other until the track sub-section is positioned at the desired level.

To ensure enhanced durability and permanence of the correction, it is useful to work with a level correction value somewhat exceeding the desired level so that the rail may be lifted to that level. Depending on the magnitude of the level error to be corrected, correction may be effected by operating tamping unit 7 in different modes including a single tamping, a double tamping, a triple tamping and tamping under a high tamping pressure, and the tamping mode may be automatically controlled in response to the difference between the existing level and the desired level. Normally, the first few ties nearest starting point S are subjected to a single tamping, while the ties near the maximal level errors are subjected to multiple tamping. Depending on the magnitude of the level error and also the type of ties used, high pressure tamping may be applied. As soon as the level error decreases as end point E is approached, single tamping is used again until the end point is reached. The operator views the position on monitor 14, which enables the operator to control the tamping mode. After the track position correction has been completed, tamping machine 1 is advanced again over the corrected track section to measure the corrected track position.

If a precise measurement of the track level precedes the track position correction, the measured track level correction values are fed into computer and control unit 13 separately for the left and right rails 4 to enable the correction method to proceed according to the present invention, in contrast to the conventional correction method.

What is claimed is:

1. A method for correcting the position of a track comprised of two rails fastened to ties, which comprises the steps of (a) measuring independently of each other the position of each rail of a track section to obtain and record an existing level by means of a computer and control unit, (b) electronically smoothing existing level errors exceeding a selected tolerance limit to form a desired level, (c) delimiting within the measured track section a sub-section to be brought to the desired level by fixing a starting point and an end point of the sub-section, (d) positioning a tamping unit of a track tamping machine exactly at the starting point, (e) limiting any rail lifting at the starting point to the level of an uncorrected track section adjacent the starting point, and (f) bringing the sub-section to the desired level by lifting and tamping each rail independently of each other until the track sub-section is positioned at the desired level.

2. The track position correcting method of claim 1, wherein the existing level of each rail is recorded independently of each other, and the recorded level of each rail is graphically displayed on a monitor.

3. The track position correcting method of claim 1, wherein the position of the tamping unit relative to the track is graphically displayed on a monitor.

4. The track position correcting method of claim 1, wherein the tamping unit is configured to operate in different modes including a single tamping, a double tamping and a triple tamping producing a high tamping pressure, and the tamping mode is automatically controlled in response to the difference between the existing level and the desired level.

* * * * *